US006318015B1

(12) United States Patent
Baumann et al.

(10) Patent No.: US 6,318,015 B1
(45) Date of Patent: Nov. 20, 2001

(54) COLLIMATOR HOLDING DEVICE FOR A WEAPON BARREL

(75) Inventors: Berthold Baumann, Eschede; Hartmut Wagner, Unterlüss, both of (DE)

(73) Assignee: Rheinmetall W & M. GmbH, Unterlüss (DE)

( * ) Notice: Subject to any disclaimer, the term of this patent is extended or adjusted under 35 U.S.C. 154(b) by 0 days.

(21) Appl. No.: 09/393,810

(22) Filed: Sep. 10, 1999

(30) Foreign Application Priority Data

Sep. 11, 1998 (DE) ..... 198 41 585

(51) Int. Cl.[7] ..... F41G 3/00
(52) U.S. Cl. ..... 42/111
(58) Field of Search ..... 42/100, 101, 102, 42/103, 111; 33/233, 245, 247, 248, 250, 252, 258

(56) References Cited

U.S. PATENT DOCUMENTS

| | | | | |
|---|---|---|---|---|
| 3,153,856 | * | 10/1964 | Felix | 33/247 |
| 3,171,226 | * | 3/1965 | Into | 42/102 |
| 3,193,932 | * | 7/1965 | Johnson | 33/233 |
| 3,945,142 | * | 3/1976 | Keppeler | 42/1 |
| 4,383,371 | * | 5/1983 | Coffey | 33/250 |
| 4,776,126 | * | 10/1988 | Williams | 33/247 |
| 4,779,370 | | 10/1988 | Cormack | 42/100 |
| 4,959,908 | | 10/1990 | Weyrauch | 33/245 |
| 5,033,219 | * | 7/1991 | Johnson et al. | 33/248 |
| 5,189,245 | | 2/1993 | Bundy | 89/14.1 |
| 5,376,361 | * | 12/1994 | Rustick | 33/247 |
| 5,941,489 | * | 8/1999 | Fanelli et al. | 33/245 |

FOREIGN PATENT DOCUMENTS

| | | |
|---|---|---|
| 275777 | 6/1914 | (DE) . |
| 2 283 090 | 4/1995 | (GB) . |

* cited by examiner

*Primary Examiner*—Charles T. Jordan
*Assistant Examiner*—Denise J Buckley
(74) *Attorney, Agent, or Firm*—Venable; Gabor J. Kelemen

(57) ABSTRACT

A holder assembly for supporting a collimator of a field adjusting device on a weapon barrel includes a holder sled having a dovetail guide provided in the underface of the sled. The dovetail guide has lateral guide faces converging toward one another. A first groove is provided in the underface of the sled and extends transversely to the length of the dovetail guide. A dovetail receiver block is affixed to the weapon barrel in the muzzle region. The dovetail receiver block has lateral guide faces converging toward one another. A second groove, located on the weapon barrel, extends transversely to the barrel axis. The holder sled is removably mountable on the weapon barrel by sliding the dovetail guide onto the dovetail receiver block in a direction parallel to the barrel axis until an installed state of the holder sled is reached. In the installed state the lateral guide faces of the dovetail guide and the lateral guide faces of the dovetail receiver block are in a wedging relationship and the first and second grooves are in alignment with one another. Further, a wedge block is provided which is insertable into the first and second grooves in the installed state for axially immobilizing the holder sled on the weapon barrel.

8 Claims, 1 Drawing Sheet

FIG.1
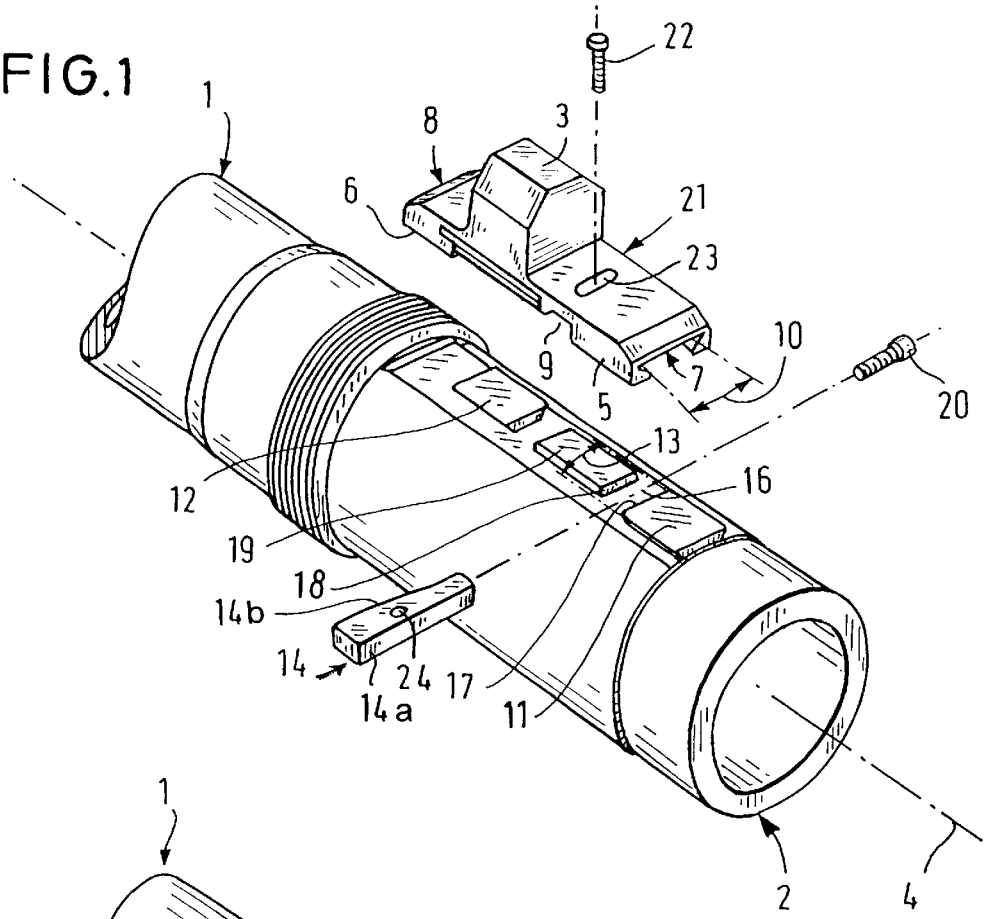
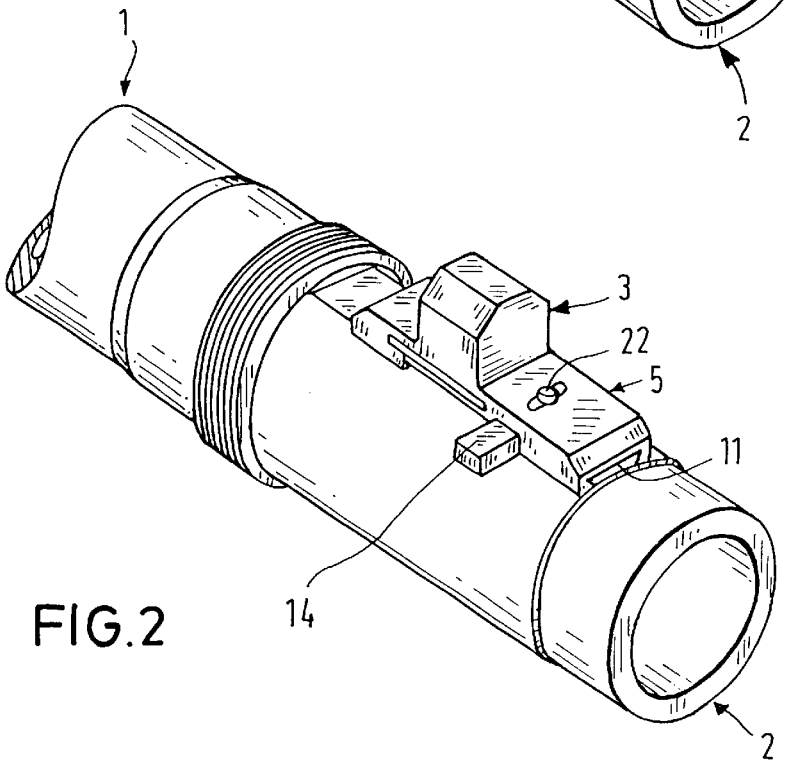
FIG.2

COLLIMATOR HOLDING DEVICE FOR A WEAPON BARREL

CROSS REFERENCE TO RELATED APPLICATION

This application claims the priority of German Application No. 198 41 585.0 filed Sep. 11, 1998 , which is incorporated herein by reference.

BACKGROUND OF THE INVENTION

The invention relates to a collimator holding device mounted on a weapon barrel, close to the muzzle. The collimator holding device serves for temporarily securing a collimator of a field-adjusting apparatus to the weapon barrel.

During the course of the firing operation weapon barrels are significantly heated by virtue of the heat transfer from the hot gases and burning powder to the barrel wall. Such a phenomenon takes place particularly during serial firing. With an increasing heat-up of the weapon barrel the barrel muzzle frequently sags and thus a deterioration of the accuracy of the weapon results.

For this reason, during firing operation, as a rule a follow-up adjustment of the weapon has to be effected by means of "field-adjusting" devices. A field adjusting device verifies the position of the muzzle with the aid of an optical assembly (collimator) situated at the barrel muzzle and, if necessary, corrective steps may be taken. For such a procedure, the collimator is secured to the barrel muzzle by means of a special collimator holding device.

It is known to connect the collimator holder with the weapon barrel by means of screws. Such a solution, however, is disadvantageous in that relatively wide securing surfaces need to be made available on the weapon barrel. Further, a sufficient screw depth in the weapon barrel has to be ensured for the securing screws. Because of these requirements, at the barrel muzzle a significant amount of barrel material has to be present which disadvantageously affects the oscillating behavior of the weapon barrel and also aids the above-described muzzle sagging. It has further been found that problems are encountered with the securing screws which often become loose.

When tubular collimator holders are used, it has been proposed to secure such tubes to the weapon barrel by means of shrunk-on rings. It is, among others, a disadvantage of such a solution that it involves a substantial technological outlay and, in addition, as in the earlier discussed solution, such a solution requires a significant mass of material in the muzzle region of the weapon barrel.

SUMMARY OF THE INVENTION

It is an object of the invention to provide an improved collimator holding device of the above-outlined type which may be mounted easily and in a user friendly manner on the weapon barrel and which requires only an insignificant increase of the material mass in the region of the barrel muzzle. It is a further object to provide a collimator holder that can be affixed without any play to the region of the barrel muzzle.

These objects and others to become apparent as the specification progresses, are accomplished by the invention, according to which, briefly stated, the holder assembly for supporting a collimator of a field adjusting device on the weapon barrel includes a holder sled having a dovetail guide provided in the underface of the sled. The dovetail guide has lateral guide faces converging toward one another. A first groove which is provided in the underface of the sled extends transversely to the length of the dovetail guide. A dovetail receiver block is affixed to the weapon barrel in the muzzle region. The dovetail receiver block has lateral guide faces converging toward one another. A second groove, located on the weapon barrel, extends transversely to the barrel axis. The holder sled is removably mountable on the weapon barrel by sliding the dovetail guide onto the dovetail receiver block in a direction parallel to the barrel axis until an installed state of the holder sled is reached. In the installed state the lateral guide faces of the dovetail guide and the lateral guide faces of the dovetail receiver block are in a wedging relationship and the first and second grooves are in alignment with one another to form a passage. Further, a wedge block is provided which is insertable into the passage in the installed state for axially immobilizing the holder sled on the weapon barrel.

It is the basic principle of the invention to provide, as a collimator holder, a sled with a dovetail guide in which the two lateral guiding faces of the dovetail guide converge. The sled is inserted into the dovetail receiver block which is situated at the barrel muzzle and which too, has converging lateral guide faces. By virtue of the lateral guide faces of the dovetail guide and the dovetail receiver block, in conjunction with the inclination of such guide faces as viewed cross-sectionally, the sled is clamped (wedged) within the dovetail receiver block as the dovetail guide is slid onto the dovetail receiver block.

A positive axial immobilization of the sled is effected by a wedge block which has converging sides cooperating with converging sides of a groove situated on the weapon barrel and extending transversely to the barrel axis. The wedge block presses the sled into its wedged end position and axially immobilizes the sled which, upon firing, seeks to creep into the firing direction by virtue of inertia.

It has been found advantageous to provide that the wedge angle formed between the lateral guide faces of the dovetail guide and between the lateral guide faces of the dovetail receiver block is between 2° and 5°.

It also has been found advantageous to provide that the lateral faces of the transverse wedge and the corresponding engagement faces of the groove on the weapon barrel have a wedge angle which is between 3° and 8°.

BRIEF DESCRIPTION OF THE DRAWINGS

FIG. 1 is a perspective view of a large caliber weapon barrel showing a preferred embodiment of the collimator holder in an exploded view (that is, before mounting on the weapon barrel).

FIG. 2 is a perspective view similar to FIG. 1 illustrating the collimator holder after its securement to the weapon barrel.

DESCRIPTION OF THE PREFERRED EMBODIMENT

FIG. 1 illustrates a weapon barrel 1 having a muzzle 2. A collimator holder 3 to be attached to the barrel 1 adjacent the muzzle 2 is configured as a sled which has a front end and a rearward end as related to the front (muzzle) end and the rearward end of the weapon barrel. On its underside (that is, on its face oriented towards the weapon barrel 1 in the installed state) the sled (collimator holder) 3 has, as viewed parallel to the barrel axis 4, a frontal and rearward foot region 5 and 6. Each of the two foot regions 5 and 6 is provided with a respective dovetail guide 7 and 8 between which the sled is provided with a groove 9 which extends transversely to the sled length.

The two lateral guide faces of the respective dovetail guides 5 and 6 converge toward one another toward the sled rear and thus constitute a wedge having a wedge angle 10 which is preferably between 2° and 5°. For this purpose at least one of the lateral guide faces forms an acute angle with the length direction of the sled 3.

The sled 3 may be slid onto spaced dovetail receiver blocks 11 and 12 affixed to the weapon barrel 1. The lateral guide faces of the dovetail receiver blocks 11, 12 likewise have a wedge-shaped configuration which widens in the direction of the barrel muzzle 2 and which has a wedge angle 13 of preferably 2° to 5°.

A web plate 19 is affixed to the weapon barrel 1 between the dovetail receiver blocks 11 and 12. The frontal edge 18 of the web plate 19 and the rearward edge 17 of the frontal dovetail receiver block 11 define a groove 16 which extends transversely to the barrel axis 4. The edges 17 and 18 form a wedge to cooperate with an insertable wedge block 14 having converging sides 14*a* , 14*b* as will be apparent as the specification progresses. The wedge angle of the wedge block 14 and that of the edges 17, 18 is preferably 3° to 8°.

In the description which follows, the mode of fastening the collimator holder sled 3 to the weapon barrel 1 will be set forth.

First, the holder sled 3 is positioned in a longitudinal alignment with the dovetail receiver blocks 11, 12 in such a manner that the frontal foot region 5 is situated behind the frontal dovetail receiver block 11 and the rearward foot region 6 is situated behind the rearward dovetail receiver block 12. Thereafter the holder sled 3 is pushed towards the muzzle 2 onto the dovetail receiver blocks 11 and 12 until the grooves 9 and 16 are in alignment and the lateral guide faces of the dovetail guides 7, 8 cooperating with the lateral guide faces of the dovetail receiver blocks 11, 12 are in a wedging relationship. Thereafter the wedge block 14 is transversely pushed into the passage formed by the grooves 9 and 16 as illustrated in FIG. 2.

By inserting and then turning a first screw 20 whose head is countersupported by the outer face of the side wall 21 of the sled 3 and which is threaded into the end face of the wedge block 14, the wedge block 14 is pulled between the guide faces 17 and 18, and thus by virtue of a camming effect by the converging sides 14*a*, 14*b* of the wedge block 14 the sled 3 may be still further pushed axially forward into an even more pronounced wedging engagement between the wedges formed by the dovetail guides 7, 8 and the wedges formed between the dovetail receiver blocks 11 and 12.

The thus-obtained clamping between the dovetail receiver blocks 11, 12 and the dovetail guides 7, 8 of the sled 3 results in a play-free positioning of the sled 3. An additional spline (not shown for clarity) provided on the transverse wedge 14 and extending into a groove provided on the sled, prevents an axial creeping of the sled 3 towards the barrel muzzle 2 during firing.

As a precaution, the transverse wedge 14 may be secured by a second screw 22 to the sled 3. The screw 22 passes through a slot 23 in the sled 3 and is threaded into a hole 24 provided in a top face of the wedge block 14. The screw 22 further serves to pull the inserted wedge block 14 radially outwardly (with respect to the barrel axis 4) against the sled 3 and thus to lift it off the weapon barrel within the groove 16. Both the first and the second screws 20, 22 are preferably secured against loosening.

If required, the holder sled 3 can be removed without difficulty. For this purpose, first the wedge block 14 is released and pulled out of the sled 3. Thereafter the sled 3, by applying a slight pressure to its frontal end in a direction away from the muzzle 2, is pushed out of the dovetail receiver blocks 11, 12.

It is to be understood that the invention is not limited to the above-described embodiment. Thus, for example, the sled does not need to have two separate foot regions with dovetail guides; rather, a single (for example, through going) dovetail guide could be used.

Also, it is not necessary that both lateral guide faces of the dovetail guides be inclined relative to the barrel axis 4; rather, it suffices if only a single lateral guide face has such an inclination.

It will be understood that the above description of the present invention is susceptible to various modifications, changes and adaptations, and the same are intended to be comprehended within the meaning and range of equivalents of the appended claims.

What is claimed is:

1. A combination of a weapon barrel and a holder assembly for supporting a collimator of a field adjusting device on said weapon barrel; said weapon barrel having a barrel axis and a muzzle; said holder assembly comprising (a) a holder sled having
  (1) an underface;
  (2) a dovetail guide provided in said underface; said dovetail guide having
    (i) a length;
    (ii) a front;
    (iii) a rear; said front and said rear bounding said length; and
    (iv) lateral guide faces converging toward one another; and
  (3) a first groove provided in said underface and extending transversely to said length;

(b) a dovetail receiver block affixed to said weapon barrel in a region of said muzzle; said dovetail receiver block having lateral guide faces converging toward one another;

(c) means affixed to said weapon barrel for defining a second groove extending transversely to said barrel axis; said holder sled being removably mountable on said weapon barrel by sliding said dovetail guide onto said dovetail receiver in a direction parallel to said barrel axis until an installed state of said holder sled is reached; in the installed state the lateral guide faces of said dovetail guide and the lateral guide faces of said dovetail receiver block are in a wedging relationship and said first and second grooves are in alignment with one another to form a passage; and (d) a wedge block insertable into said passage and having converging sides for urging said holder sled into said installed state and for axially immobilizing said holder sled on said weapon barrel.

2. The combination as defined in claim 1, wherein an angle defined between said lateral guide faces of said dovetail guide and between said lateral guide faces of said dovetail receiver block is between 2° and 5°.

3. The combination as defined in claim 1, wherein said lateral guide faces of said dovetail guide converge toward one another toward said rear and said lateral guide faces of said dovetail receiver block converge in a direction away from said muzzle; and further wherein in the installed state of said holder sled said front of said dovetail guide is oriented toward said muzzle.

4. The combination as defined in claim 1, wherein said second groove has two lateral guide faces; further wherein an angle defined between said converging sides of said wedge block and said lateral guide faces of said second groove is between 3° and 8°.

5. The combination as defined in claim 1, wherein said dovetail guide is divided into a frontal and a rearward partial dovetail guide; said frontal and rearward partial dovetail guides are spaced from one another and flank said first groove; and further wherein said dovetail receiver block is divided into a frontal and a rearward partial dovetail receiver block; said frontal and rearward partial dovetail receiver blocks being spaced from one another.

6. The combination as defined in claim 5, wherein said frontal and rearward partial dovetail guides flank said first groove.

7. The combination as defined in claim 1, wherein said wedge block has an end face which, in the inserted state of the wedge block in said passage, is located within said passage; further comprising a securing screw supported in a side wall of said holder sled and threaded into said end face of said wedge block for pulling said wedge block into said passage.

8. The combination as defined in claim 7, further comprising a slot provided in a top face of said holder sled and an additional securing screw passing through said slot and supported by said top face; said additional securing screw being threaded into a face of said wedge block.

* * * * *